United States Patent [19]

Lange

[11] Patent Number: 4,680,926

[45] Date of Patent: Jul. 21, 1987

[54] PROCESS AND APPARATUS FOR THE PRODUCTION OF OVAL CHAIN LINKS FROM ROUND WIRE

[75] Inventor: Gerhard Lange, Reutlingen, Fed. Rep. of Germany

[73] Assignee: WAFIOS Maschinenfabrik GmbH & Co. Kommanditgesellschaft, Fed. Rep. of Germany

[21] Appl. No.: 795,915

[22] Filed: Nov. 7, 1985

[30] Foreign Application Priority Data

Nov. 9, 1984 [DE] Fed. Rep. of Germany ..... 3440907

[51] Int. Cl.[4] ..... B21L 1/02

[52] U.S. Cl. ..... 59/27; 59/23; 59/35.1

[58] Field of Search ..... 59/18, 27, 23, 22, 25, 59/31, 35.1, 24; 72/461, 331, 332, 337; 140/88

[56] References Cited

U.S. PATENT DOCUMENTS

| | | | |
|---|---|---|---|
| 2,533,325 | 12/1950 | Miller et al. | 59/27 |
| 3,714,776 | 2/1973 | Lange | 59/23 |
| 3,811,268 | 5/1974 | Rahn | 59/18 |
| 3,961,474 | 6/1976 | Esser | 59/23 |

FOREIGN PATENT DOCUMENTS

| | | |
|---|---|---|
| 1123891 | 6/1957 | Fed. Rep. of Germany . |
| 1527505 | 4/1965 | Fed. Rep. of Germany . |
| 2123561 | 5/1971 | Fed. Rep. of Germany . |
| 2417207 | 10/1975 | Fed. Rep. of Germany . |
| 2438990 | 3/1976 | Fed. Rep. of Germany . |
| 319664 | 4/1957 | Switzerland . |

OTHER PUBLICATIONS

German publication "Draht", vol. 12, pp. 632, 633, 12/1976.

*Primary Examiner*—Robert L. Spruill
*Assistant Examiner*—David B. Jones
*Attorney, Agent, or Firm*—Wigman & Cohen

[57] ABSTRACT

The chain links are bent in a single bending station, using a single mandrel. Pieces of wire of a given uniform length are bent into a V-shape between a holder and a suitably shaped recess in the mandrel. A wire feed sleeve and a wire receiving sleeve are disposed opposite one another defining a wire path between the holder and mandrel. Wire guides having guide surfaces guide the wire in its feed path from the feed sleeve to the receiving sleeve. The receiving sleeve has an abutment member provided with a support surface which, with the feed sleeve, prevents the leading and trailing ends of the wire piece from moving in a direction perpendicular to the direction of wire feed during the V shape bend. The two sleeves, each of which is formed together with a bending tool, are then retracted to free the wire ends, and the bending tools are moved perpendicular to the wire feed direction to bend the wire ends around the mandrel into a C-shape. The wire ends are then bent around the same mandrel to bend the wire ends into an O-shape to close the link.

9 Claims, 4 Drawing Figures

158
176
174
162

174
158
156
176
166
178
172
162
II b
182
184
170
116
II b
110
152''''
180
112
184
182
168
154
126
152'
164
124
152
160

PROCESS AND APPARATUS FOR THE PRODUCTION OF OVAL CHAIN LINKS FROM ROUND WIRE

BACKGROUND OF THE INVENTION

1. Field of the Invention

This invention relates to a process for the production of oval chain links from pieces of round wire having a given uniform length, in which, in a single bending station, a straight piece of wire, intersecting at right-angles the longitudinal axis of a cylindrical bending mandrel having an annular groove extending round this axis in a vertical plane to receive the piece of wire, is carried next to the mandrel at the level of the groove; the piece of wire is first bent on the mandrel into a V-shaped piece with the arms of the V at an obtuse angle; the middle of the piece of wire, forming the back of the link, is moved into a recess on the mandrel at its feed side and at the level of the aforesaid groove; and the piece of wire which has thus been subjected to its initial bending is bent into the groove outside the mandrel recess until the longitudinal axis of the piece of wire follows the course of the groove.

The invention further relates to an apparatus for carrying out such a process, comprising a single bending mandrel which has a recess on the side facing the wire feed to receive the outwardly concavely curved rear section of the unwelded chain link, the middle of which recess is situated opposite a holder provided to secure a piece of wire, which holder is movable backwards and forwards at right-angles to the longitudinal axis of the mandrel; further comprising two wire bending tools arranged symmetrically on either side of the mandrel and holder, which bending tools are displaceable in a transverse plane which contains the direction of displacement and is perpendicular to the axis of the mandrel, so as to move forwards towards the two ends of the wire positioned between the mandrel and the holder from the side of the mandrel facing the holder to the side remote from the holder; and comprising an arrangement for positioning the piece of wire between the mandrel and the holder, said arrangement having a wire feed sleeve which is either displaceable together with one of the two tools or stationary, and an abutment member situated axially opposite said wire feed sleeve for the abutment of the leading free end of the wire piece.

2. Description of the Prior Art

A known chain link bending machine of the generic type mentioned above, is suitable for carrying out a process of the type described above and is used for processing so-called pins. In this apparatus, the piece of wire in the feed sleeve is pushed completely out of the sleeve by the next following piece of wire between two rollers used as bending tools and the holder remote from the mandrel on one side and the mandrel on the other side until it touches the stationary support surface of the abutment member which is in the form of a peg. In this movement, there is no lateral distance between the piece of wire and the mandrel on one side and holder on the other and the wire therefore contacts these parts but makes no contact with the bending rollers which are situated remote from the mandrel and opposite the free ends of the wire piece at the same vertical distance apart. The wire piece placed in the operative position for bending is thus clamped by the mandrel and the holder and its two ends touch the flat end face of the abutment peg and, respectively, the leading free end of the next piece of wire which is now inside the feed sleeve. For the initial bending of the piece of wire to a V-shape by means of two back bending steels, the said bending steels grip the two ends of the piece of wire perpendicularly to its longitudinal axis and the two ends are swung about the middle of the wire piece, which is supported by the holder, while the back of the unwelded chain link is formed from the piece of wire. The holder then pushes forwards against the mandrel by an amount equal to the so-called camber of the bend at the back of the link, and the middle of the now V-shaped piece of wire is moved into the recess of the mandrel. Lastly, the back bending steels and at the same time the bending rollers are moved past the mandrel and at the same time the bending rollers grip the as yet straight ends of the V-shaped wire which is now clamped at its middle between the mandrel and the holder, and the bending rollers bend the ends of the wire through more than 90° to place them round the mandrel until they form the preliminary C shape of the future chain link. In the known chain link bending machine, the piece of wire which has been bent into its preliminary C shape is closed to form the O-shaped link in one and the same station.

In the known chain link bending machine and its mode of operation, it would appear to be a disadvantage, in spite of the load being taken off the mandrel during the initial bending of the pins into their V shape, that additional time is taken up owing to the use of special back bending steels and the movement of the holder required for this purose. The output of unwelded chain links from this machine is therefore not as great as it could be if the above mentioned measures for reducing the load on the mandrel were not taken.

SUMMARY OF THE INVENTION

It was therefore an object of the present invention to provide a process for producing oval chain links from round wire and an apparatus for carrying out such process so that a relatively high productivity could be achieved, measured in the number of completely bent, unwelded chain links per unit time, but with as little load on the bending mandrel during the initial bending of the wire piece into its V shape.

To solve this problem in accordance with the invention in a process of the type mentioned above, the trailing free end of the wire piece and the leading free end of the piece are substantially prevented from moving perpendicularly to the longitudinal direction of feed of the straight piece of wire during the initial bending of the piece of wire and the simultaneous movement of the middle of the piece of wire into the recess of the mandrel. This has the advantageous effect that before the piece of wire is converted from its V shape to its C shape, that is to say during the first bending movement, the mandrel is not subjected to a load liable to cause breakage since the leading and trailing end of the wire piece are temporarily held fast by the holder, and a gain in time is achieved by the fact that the ends of the piece of wire need only be moved actively in one direction whereas in the known process a change of movement into the opposite direction is necessary after the initial bending, and furthermore, the follow-up movement of the holder is not necessary in the new arrangement.

In an apparatus of the new type mentioned above, the above defined problem underlying the invention is solved in accordance with the invention by means of the fact that the abutment member is equipped with a support surface flanking the axis of the sleeve, said support surface forming part of the positioning device for the leading end of the piece of wire and being arranged to be displaceble so as to move out of the way of the said free end to allow unobstructed conversion of the V shape of the wire piece into its C shape. Furthermore, a receiver forming part of the movable feed sleeve or a receiver which is adjacent to the stationary feed sleeve and is displaceable together with its associated bending tool is provided for the trailing free end of the piece of wire. This receiver, which forms part of the positioning arrangement for the trailing end of the wire piece, again has a support surface which flanks the axis of the sleeve and is arranged to be displaceable so as to move away from this free end of the wire to enable unhindered conversion of the V form of the wire to its C form to proceed.

By means of this sample measure, which consists mainly in making the abutment member displaceable and providing two displaceable receivers, the process according to the invention may advantageously be carried out without the use of back bending steels.

In a first embodiment of the apparatus according to the invention, in which the wire bending tools can be displaced forwards towards the two ends of the positioned wire piece and beyond the mandrel and back again in a direction perpendicular to the direction of wire feed and parallel to the direction of displacement of the wire holder, the support surface on the abutment member is arranged transversely to the direction of displacement of the tools and can be moved away from the leading end of the wire piece to allow unobstructed conversion of the V shape of the wire piece into its C shape to proceed.

The first embodiment of the apparatus according to the invention is also distinguished by a receiving sleeve which is in alignment with the feed sleeve in the direction of movement of the wire and contains the abutment member in the form of a fixed cylindrical core whose end face, facing the feed sleeve, forms an abutment surface for the wire piece and is situated inside the receiving sleeve when the latter is in the operative position ready to receive a wire, so that the annular surface of sleeve which is left untouched by the abutment member partly forms the support surface for the free end of the wire piece. This receiving sleeve is displaceable in the direction of movement of the wire between an operative position of readiness in which its exposed surface can function as support surface and an inoperative position in which its support surface is further removed from the bending mandrel. This embodiment of the apparatus according to the invention, which is particularly suitable for bending in a single bending station so that the back of the unwelded oval chain link can have a smaller curvature, is very simple to carry out.

In the first embodiment, the feed sleeve and the abutment member form the two halves of an electric switch contact.

This switch contact may form part of an electric installation for sequence control of the apparatus according to the invention and may provide protection against damage to the machine which could otherwise result from an end of a piece of wire not being pushed right forwards to the abutment.

In the second embodiment, the feed sleeve is mounted to be displaceable in the direction of movement of the wire between a near position in which its clear distance from the abutment member in the operative position, measured along the axis of this sleeve, is less than the length of the piece of wire, and a far position, in which said distance is greater than said length of wire, and the feed sleeve and receiving sleeve are driven to be displaceable both at the same time towards and away from each other so that the movements are coordinated and may be carried out by means of a single drive.

In a second embodiment of the apparatus according to the invention, a stationary wire feed sleeve is associated with an abutment member which is displaceable in the direction of movement of the wire, and each wire bending tool has a support surface for one of the free ends of the piece of wire, and the tools and support surfaces can be moved together pairwise through the space between the wire bending mandrel and the sleeve or, respectively, the wire bending mandrel and the withdrawn abutment member. This arrangement is a variation for cases in which the wire bending tools such as bending rollers are required to be moved round the bending mandrel along curved lines so that it is undesirable to move the tools apart before the piece of wire has been converted from its V shape to its C and O shape.

BRIEF DESCRIPTION OF THE DRAWINGS

The invention will now be described in detail with reference to the two embodiments of the apparatus according to the invention described in general terms above and illustrated by way of example in the schematic drawings, in which.

DESCRIPTION OF THE PREFERRED EMBODIMENTS

Figures 1A, 1B:
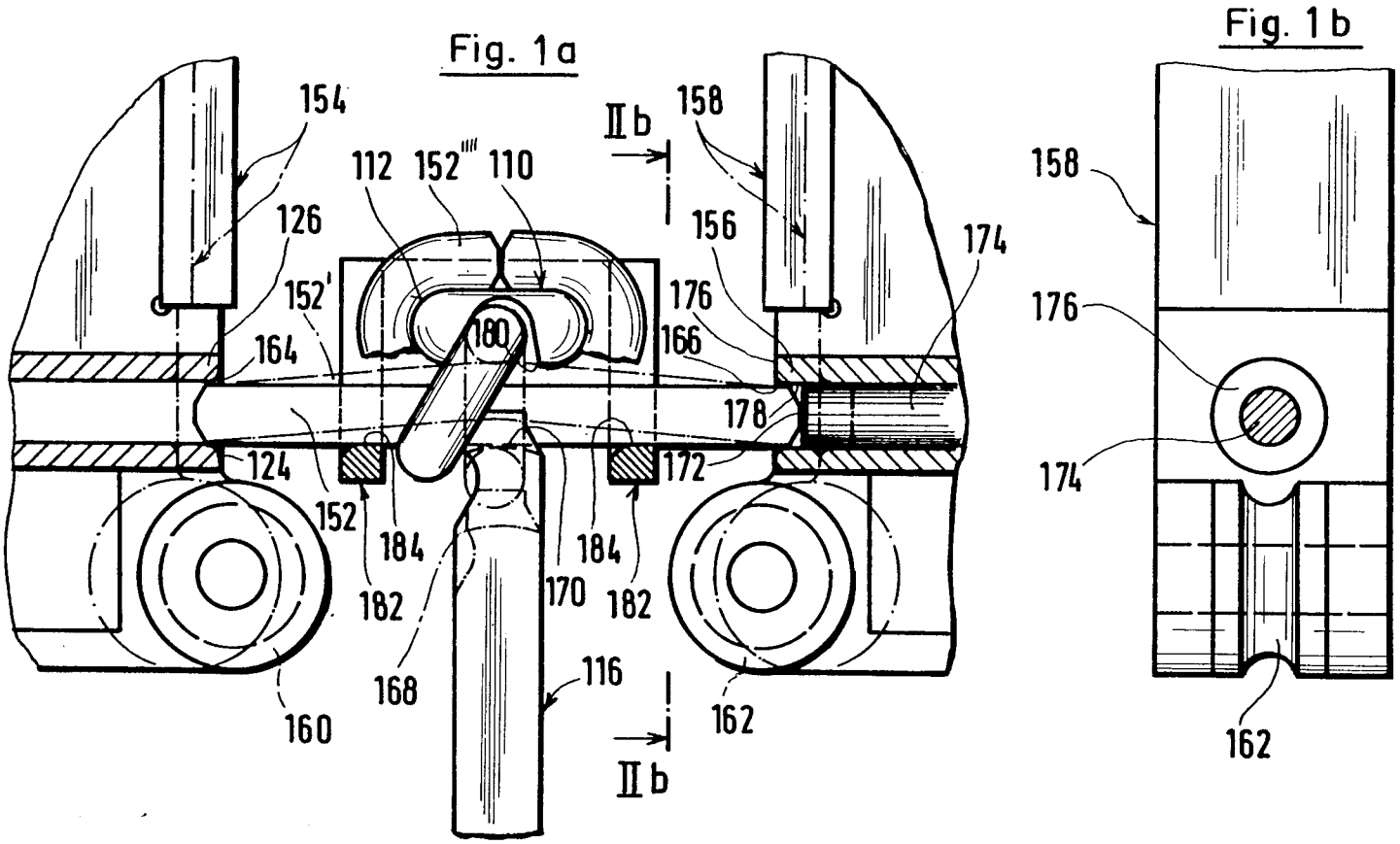
FIG. 1*a* is an elevational view of the first embodiment comprising a single bending station and 1*b* is a partial view taken on the section line IIb—IIb.

The first embodiment of the apparatus according to the invention shown in FIG. 1 is a single mandrel bending machine for a conventional simple bending process in which all the bending movements are carried out in one and the same station. Since this station is used for working up previously manufactured wire pieces, the apparatus is equipped with a notching or cutting device (not shown) which separates pieces of wire 152 of equal length from a continuously supplied wire, the said separate pieces successively entering a wire feed sleeve 126 which can be moved forwards and backwards by a certain amount on its longitudinal axis together with a first bending tool holder 154. The same applies to the wire receiving sleeve 156 and a second bending tool holder 158 which can be moved backwards and forwards parallel with the first bending tool holder 154 and simultaneously with this holder in a direction perpendicular to the direction of wire feed which is given by the colinear longitudinal axes of the two sleeves 126 and 156. Each of the two holders 154 and 158 carries one of the two sleeves, namely the sleeve 126 or 156, respectively, and as bending tool it carries a bending roller 160 or 162, respectively, these rollers being so arranged on their holders that when they are moved in a straight line, they grip the free ends of that piece of wire 152 which is situated at that moment in such a position between the two sleeves 126 and 156 that the two ends of the wire extend into the sleeves 126 and 156 which are at that stage situated in their positions close to one another. The bores of these sleeves are provided at their ends facing each other with an edge which is rounded off at 164 and 166, respectively, so that the leading free end of the piece of wire 152 is guided into the receiving sleeve 156 and the annular edges of the ends of the wire piece can easily be removed from the two sleeves 126 and 156 whose internal diameter is slightly greater than the diameter of the wire pieces 152 so that the free ends of the wire piece 152 can be set slightly obliquely when the wire is first bent into an obtuse angled V shape. Situated between the two bending rollers 160 and 162 illustrated in their operative position of readiness is a wire holder 116 which is displaceable backwards and forwards between the bending tool holders 154 and 158 in the same direction as these holders so as to be moved towards and away from the single bending mandrel 110. The holder 116 has a groove 168 at its end facing the bending mandrel 110. The base of this groove ascends in the direction of wire feed so that the holder in its operative position guides the leading end of the wire piece 152 leaving the feed sleeve 126 towards the receiving sleeve 156 in a straight line. The groove 168 forms a saddle 170 in the location where the middle of the wire piece 152 lies before it is bent and when the wire has been axially positioned by abutting with its leading free end against a circular end face 172 on a core 174 in the receiving sleeve 156 facing the feed sleeve 126, which core is rigidly connected with the receiving sleeve 156 and therefore also with the bending tool holder 158. The receiving sleeve 156 frms a semicircular cylindrical support surface 178 facing the bending roller 162 when the bending tool holder 158 is in its position close to the bending mandrel 110 so that the support surface 178 acts on the wire piece 152 which is positioned for the initial bending movement whereas said support surface is ineffective when the bending tool holder 158 has been moved away from the bending mandrel 110. The bending mandrel 110 is situated opposite the holder 116 in the direction of movement of said holder and its longitudinal axis is perpendicular to that of the holder and to the straight line connecting the axes of the sleeves. In addition to its recess 180 for receiving the previously manufactured, as yet unwelded chain link, the mandrel 110 has an annular groove 112 for receiving a piece of wire 152, said groove having a depression, situated opposite the saddle 170 of the holder 116, which depression is formed by the recess 180. The arrangement is such that when the piece of wire 152 has been pushed forwards between the fixed mandrel 110 and the holder 116 in its end position until it abuts against the core 174 in the receiving sleeve, it lies on the saddle 170 of the holder but is spaced apart from the base of the annular groove 112, that is to say from the longitudinal edges of the mandrel recess 180 extending perpendicularly to the plane of the drawing, so that the initial deformation of the straight piece of wire can be effected. In the example illustrated, this distance is less than half the diameter of the pieces of wire 152.

To guide the wire piece 152 accurately into the receiving sleeve 156, guides 182 are arranged on both sides of the bending mandrel 110. The guide surfaces 184 situated on the side of the guides 182 facing the holder are chamfered off at the edge facing the guide sleeve 126.

It should be remembered that in the first embodiment, the initial and final bending are effected in one and the same station by means of a single bending mandrel 110.

The first embodiment, which conforms with the process according to the invention but may otherwise be constructed as desired, operates as follows:

Starting at the stage illustrated in FIG. 1, in which the holder 116 is withdrawn from the bending mandrel 110, as indicated by dash-dot lines, the two bending rollers 160 and 162 are situated one on each side of the holder, the two sleeves 126 and 156 on the tool holders 154 and 158 have moved towards one another and the straight line connecting the sleeves between the mandrel and the guides 182 is closer to the guide surfaces 184 than to the base of the annular groove 112, the holder 116 leaves room for the previously produced chain link, shown in dash-dot lines, which is still in the mid-position between the sleeves 126 and 156. If now a piece of wire 152 is pushed out of the feed sleeve 126 towards the receiving sleeve 156, touching on its way the guide surfaces 184 of the guides 182, this fresh piece of wire leaves the mandrel 110 untouched and finally strikes with its leading free end against the core 174 of the receiving sleeve 156. When the wire piece 152 has been pushed into the sleeve 156, the previously produced chain link is moved into its oblique position with respect to the sleeves 126 and 156, as shown by its solid line, so that the holder 116 can be pushed forwards momentarily into an intermediate position shown by its solid lines, and when the holder 116 finally moves forwards towards the bending mandrel 110, the wire piece 152 which has been positioned as previously described is bent into an obtuse angled V, and the saddle 170 of the holder pushes the middle of the piece of wire into the mandrel recess 180 until it meets the base of the annular groove 112, and the two sleeves, including the support surface 178 in the receiving sleeve 156, serve as counter-abutments which temporarily fix the ends of the piece of wire 152. Thereafter, the two tool holders 154 and 158 together with the sleeves 126 and 156 move apart until the two ends of the V-shaped wire 152, which have previously been held, are released. The two bending tool holders 154 and 158 are then displaced until the two bending rollers 160 and 162 grip the ends of the wire piece 152' which are still straight, and swing these ends round the bending mandrel 110 through an angle slightly greater than 90° until the wire piece 152" has been bent into the form of a C. Lastly, the wire piece 152 is bent into its O shape (not shown) either by means of the two bending rollers 160 and 162 or by means of other bending tools, for example, by first moving the first bending tool holder 154 forwards and backwards parallel to the direction of wire feed so that the straight end of the wire piece 152" situated on the left in FIG. 1 is rolled into the annular groove 112, and then proceeding similarly with the second bending tool holder 158. The two ends of the piece of wire 152 therefore abut against each other and are ready for welding which, however, is carried out in a separate welding machine. During the bending process, after the wire has been bent into the form of a V, the holder 116 and bending mandrel 110 clamp the piece of wire so firmly between them that the back-bend of the resulting chain link into the mandrel recess 180, which occurred during the initial bending of the straight piece of wire 152, is not lost during the subsequent bending movements.

This is also the reason why in this single-mandrel bending process the curvature bent into the back may be much less than in the two-mandrel bending process, where this curvature of the back is partly lost when the C-shaped wire is closed up into its O shape in a second bending station.

Figure 2B:
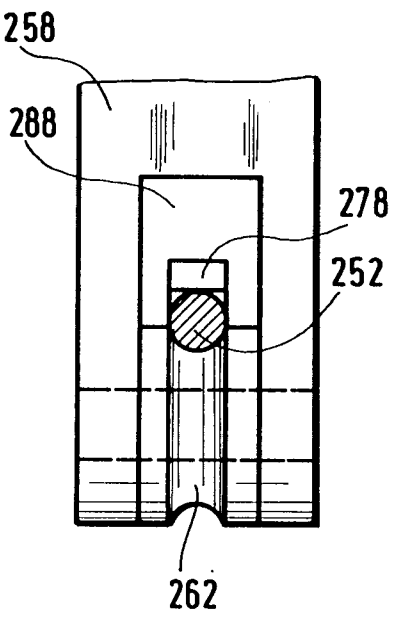
FIG. 2*a* is a view of the second embodiment corresponding to that of FIG. 1*a* and 2*b* is a partial view corresponding to that of FIG. 1*b* taken on the section line IIIb—IIIb.
Figure 2A:
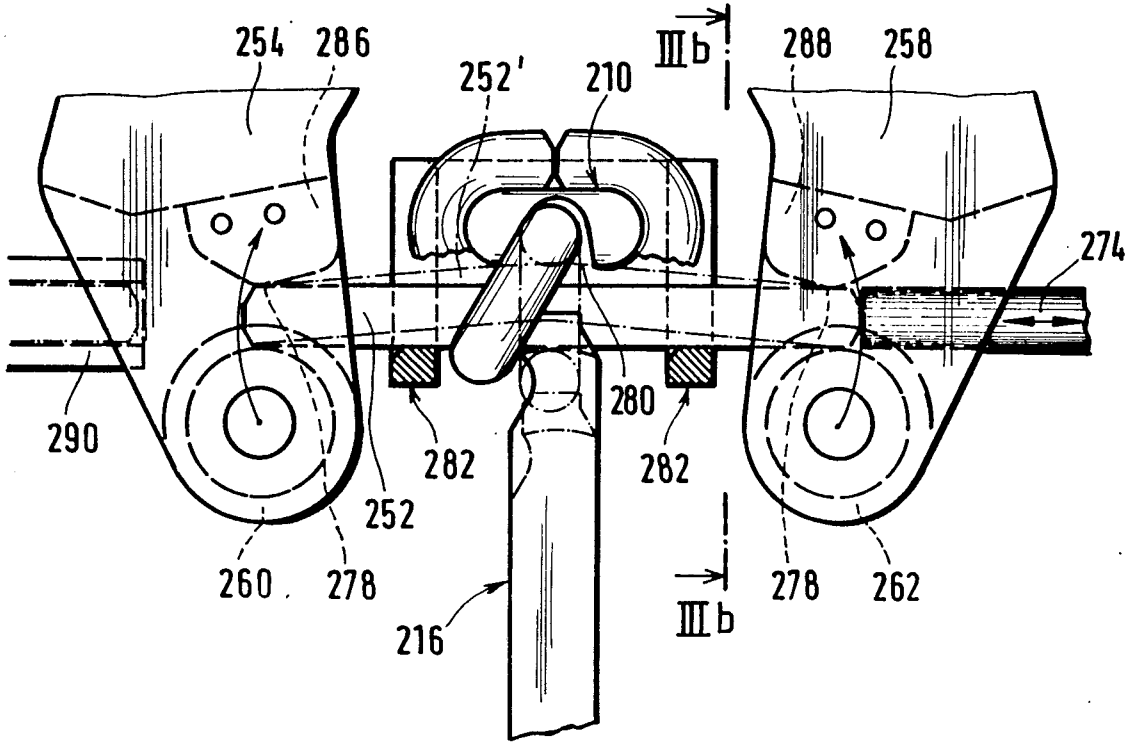

The second embodiment illustrated in FIG. 2 differs from the first in that the bending tool holders 254 and 258 consist of rocking levers with forked ends mounted on carriages, and instead of providing a wire feed sleeve 126 and wire receiving sleeve 156, replaceable U-shaped inserts 286 and 288 are inserted to form two cylindrically profiled support surfaces 278 for the initial bending of each piece of wire 252 into its obtuse angled V shape. Each support surface 278 together with its associated bending roller 260 or 262 forms a receiving surface increasing in width towards the front and back to hold one of the two ends of the piece of wire 252 which is introduced from a stationary sleeve 290 to pass through the first of the movable receivers positioned to receive the wire. After passing through the first receiver, the wire is introduced into the guides 282 and continues to move forwards until its leading end enters the second positioned receiver 278-262 and finally encounters the end face of the peg 274 which serves as abutment member to replace the core 174 of the receiving sleeve 156 on the second bending tool holder 158. This peg 274 is longitudinally displaceable on a stationary part of the apparatus (not shown) in the direction of wire feed, the said direction being determined by the axis of the sleeve 290 and the guides 282. This longitudinal displacement of the peg 274 enables it to move out of the way of the adjacent bending roller 262 before the V-shaped wire piece 252' is bent into its C shape, and at the same time the saddle formed by the support surfaces 278 ensures that the ends of the wire piece 252' remain straight.

Both embodiments are provided with an arrangement for positioning the wire piece 152 or 252, respectively. In the first embodiment shown in FIG. 1, this arrangement consists of the feed sleeve 126, the receiving sleeve 156 and the abutment member 174 whereas in the second embodiment shown in FIG. 2 it is formed on one side by the sleeve 290, the roller 260 and the support surface 278 situated opposite to it while on the other side it is formed by the roller 262, the support surface 278 situated opposite to it and the abutment member 274.

I claim:

1. A process for the production of oval chain links from pieces of wire of a given uniform length, comprising the steps of:

providing a single bending station having a cylindrical bending mandrel having a longitudinal axis and an annular groove extending round this axis in a vertical plane;

guiding a straight piece of wire, with its axis crossing at right angles with the longitudinal axis of said mandrel, in its longitudinal direction alongside of the mandrel at a free distance from said mandrel at the level of the groove;

first bending the piece of wire at the mandrel into a V-shaped piece with the arms of the V at an obtuse angle;

moving the middle of the piece of wire, forming the back of the link, perpendicularly to the mandrel axis and to the straight wire piece axis into a recess on the mandrel at its feed side and at the level of the said groove; and bending the piece of wire which has thus been subjected to its initial bending into a C shape around the mandrel; and, finally bending said piece of wire into an O shape by bending said piece of wire into the groove outside the mandrel recess until the longitudinal axis of the piece of wire follows the course of the groove, further comprising;

preventing the trailing free end of the piece of wire and the leading free end of said piece of wire from moving to any significant extent in a direction perpendicular to the longitudinal direction and direction of feed both of the straight piece of wire during the initial bending of the piece of wire and the simultaneous movement inwards of its middle into the mandrel recess by applying two parallel reactive forces on said free wire piece ends, respectively, in a direction opposite to the wire piece middle moving direction thereby preventing the free ends of the piece of wire from moving in the middle moving direction during the movement of the middle of the piece of wire towards the mandrel.

2. Apparatus for the production of oval chain links from a piece of wire of a given uniform length at a single bending station, said links being formed to have an externally concave rear section, comprising:

a single bending mandrel (110;210) which has a recess (180;280) on one side which faces the wire feed to receive an externally concave rear section of the as yet unwelded chain link;

a holder arranged opposite said mandrel for cooperation with said mandrel, said holder being positioned opposite the middle of said recess and facing said recess to secure a piece of wire (152;252) therebetween, which holder is movable backwards and forwards at a right angle to the longitudinal axis of the mandrel;

further comprising two wire bending tools (160;162; 260,262) arranged symmetrically on either side of the mandrel and holder for cooperating with said mandrel to bend a wire piece therebetween, which bending tools are displaceable in a transverse plane which contains the direction of displacement of the bending tools and is perpendicular to the axis of the mandrel, so as to move towards the two ends of the wire positioned between the mandrel and the holder from the side of the mandrel facing the holder to the side remote from the holder; and comprising an arrangement (126, 182, 156, 174; 290, 278-260, 282, 278-262, 274) for positioning the piece of wire between the mandrel and the holder, said arrangement having a wire feed sleeve (126;290), and an abutment member (174;274) located axially and oppositely on either side of the mandrel and disposed together with said wire feed sleeve along an axis perpendicular to the direction of movement of said holder, said wire feed sleeve cooperating with said abutment member for the abutment of the leading free end of the wire piece, wherein said abutment member (174;274) includes a first support surface (178;278) of the positioning arrangement for the leading end of the wire piece (152;252), which first support surface flanks the axis of the sleeve and is arranged to be movable to move out of the way of the said free end of the wire to enable unhindered conversion of the V-shaped wire into a C-shaped piece to take place; and in that a receiver is provided for the trailing free end of the piece of wire (152;252), which receiver contains a second support surface (at 164;278) of the positioning arrangement to support the trailing free end of the wire, said second support surface (at 164;278) flanking the axis of the sleeve and being arranged to be capable of moving out of the way of said free end so as to provide for unhindered conversion of the V-shape of the wire piece into a C-shape.

3. Apparatus according to claim 2, characterized in that the wire feed sleeve (126) is displaceable together with one of the two wire bending tools, and in that the receiver (at 164) is formed by the movable feed sleeve (126).

4. Apparatus according to claim 3, in which the wire bending tools (160,162) can be moved forwards towards the two ends of the positioned wire piece (152) and beyond the mandrel and back again in a direction perpendicular to the direction of wire feed and parallel to the direction of displacement of the wire holder, characterised in that the support surface (178) is arranged at the abutment member (174) transversely to the direction of displacement of the tools (160,162) and can be removed from the leading end of the wire piece (152) to provide for unhindered conversion of the V-shape of said wire piece into its C-shape.

5. Apparatus according to claim 3 or 4, characterised by a receiving sleeve (156) which is in alignment with the feed sleeve (126) in the direction of wire feed and contains the abutment member as a cylindrical core (174) whose end surface (172) facing the feed sleeve forms an abutment surface for the wire piece (152) and is situated inside the receiving sleeve which is in a position of readiness to receive the wire, so that the annular surface of said sleeve not in contact with the abutment member partly forms the support surface (178) for the free end of the piece of wire, the receiving sleeve (156) being displaceable in the direction of wire feed between a position of readiness in which its exposed surface (178) is effective as support surface and an inoperative position in which its support surface is further removed from the bending mandrel (110).

6. Apparatus according to claim 5, characterised in that the feed sleeve (126) and the abutment member (174) constitute the two halves of an electric switch contact forming part of an electrical system for use in sequence control of said oval chain link production apparatus.

7. Apparatus according to claim 3 characterised in that the feed sleeve (126) is mounted to be displaceable in the direction of wire feed between a near position in which its clear distance from the abutment member (174) (which is in a position of readiness) measuring along the axis of said sleeve (126) is less than the length of the piece of wire and a far position in which said distance is greater than the length of the piece of wire, and in that the feed sleeve (126) and the receiving sleeve (156) are driven to be simultaneously displaceable towards or away from each other.

8. Apparatus according to claim 2, characterized in that the wire feed sleeve (290) is stationary, and in that the receiver (278-260) is adjacent to the stationary wire feed sleeve (290) and is movable in conjunction with its associated bending tool (260).

9. Apparatus according to claim 8 characterised in that an abutment member (274) displaceable in the direction of wire feed is associated with a stationary wire feed sleeve (290), and in that each wire bending tool (260,262) is provided with a support surface (278) for one of the free ends of the wire piece (252), the tools and support surfaces being movable together in pairs through the space between the wire bending mandrel (210) and the sleeve or, respectively, between the mandrel (210) and the withdrawn abutment member.

* * * * *